US005884411A

United States Patent [19]

Raber

[11] Patent Number: 5,884,411

[45] Date of Patent: Mar. 23, 1999

[54] TRUSS ALIGNMENT APPARATUS

[76] Inventor: William G. Raber, 134 Holiday Dr., Hampstead, N.C. 28443

[21] Appl. No.: 984,437

[22] Filed: Dec. 3, 1997

Related U.S. Application Data

[60] Provisional application No. 60/033,939 Dec. 13, 1996.

[51] Int. Cl.[6] ..... G01D 21/00

[52] U.S. Cl. ..... 33/613; 269/904; 269/910

[58] Field of Search ..... 33/613, 423, 451, 33/484, 645, 533; 269/43, 45, 904, 905, 909, 910

[56] References Cited

U.S. PATENT DOCUMENTS

| | | | |
|---|---|---|---|
| 2,686,959 | 8/1954 | Robinson | 33/613 |
| 3,201,874 | 8/1965 | Christy | 33/613 |
| 4,322,064 | 3/1982 | Jarvis . | |
| 4,704,829 | 11/1987 | Baumker, Jr. | 33/613 |
| 4,843,726 | 7/1989 | Ward . | |
| 5,129,153 | 7/1992 | Burns, Sr. | 33/613 |
| 5,163,233 | 11/1992 | Benson | 33/613 |
| 5,490,334 | 2/1996 | Payne | 33/613 |
| 5,628,119 | 5/1997 | Bingham et al. | 33/613 |

*Primary Examiner*—Christopher W. Fulton

[57] ABSTRACT

A building frame alignment apparatus includes a T-shaped beam member which includes a top planar portion and a bottom planar portion which projects from the top planar portion at a right angle. A longitudinally oriented leveling indicator assembly is connected to the bottom planar portion, and a transversely oriented leveling indicator assembly is connected to the bottom planar portion. The bottom planar portion includes a plurality of beam-reception notches positioned longitudinally along a bottom edge of the bottom planar portion. Side walls of the beam-reception notches are oriented perpendicular to the top planar portion. The plurality of beam-reception notches includes a first beam-reception notch located at a first end of the bottom planar portion, a second beam-reception notch located at a second end of the bottom planar portion, and a third beam-reception notch located on the bottom planar portion between the first beam-reception notch and the second beam-reception notch. The beam-reception notches include two side walls and a top wall which is perpendicular to the two side walls. The top planar portion includes a writing-implement access channel. A writing implement, such as a pencil, can be used with the writing-implement access channel to enable scribing on a board. The bottom planar portion bisects the top planar portion. An adjustable clamping assembly is connected to the top planar portion.

13 Claims, 3 Drawing Sheets

FIG 1
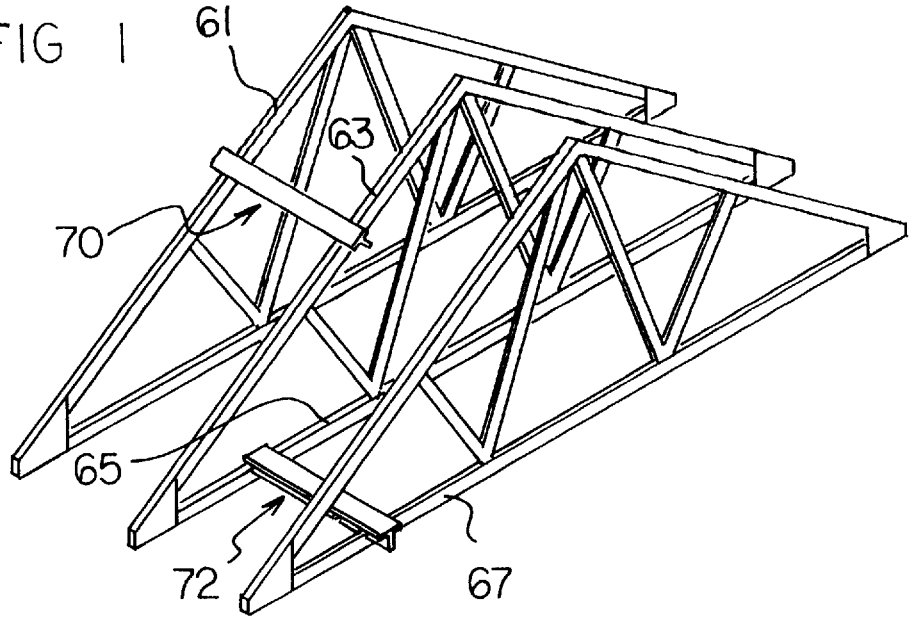
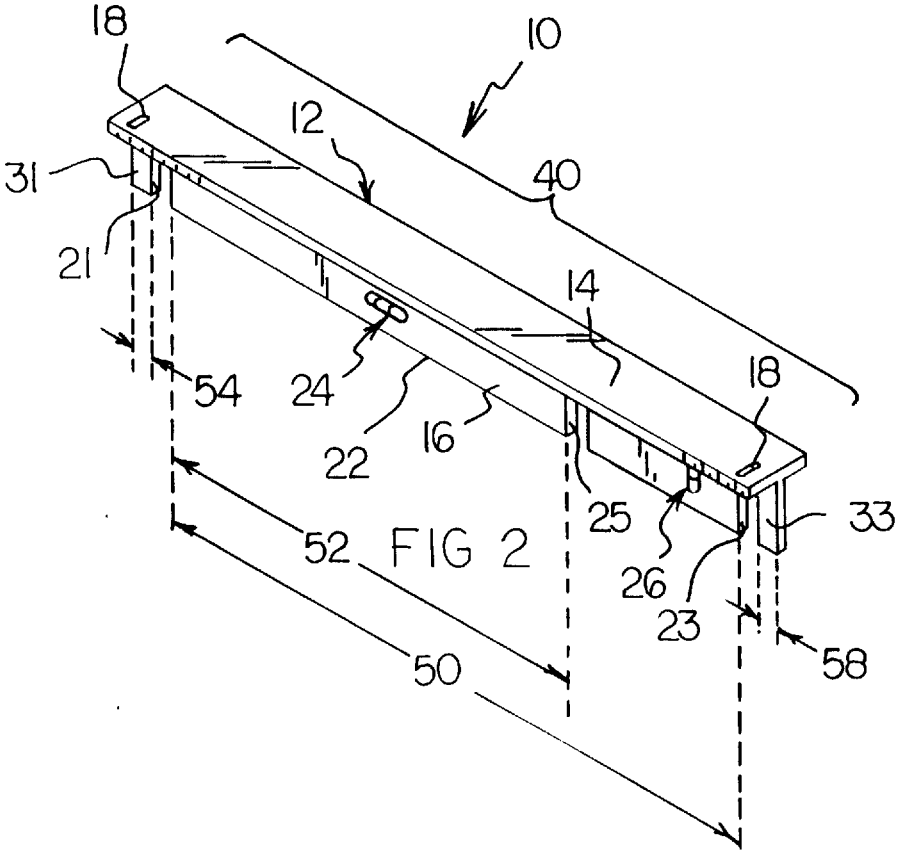
FIG 2

TRUSS ALIGNMENT APPARATUS

BACKGROUND OF THE INVENTION

1. Cross-Reference to Related Application

This application claims priority based my copending Provisional Application Ser. No. 60/033,939, filed Dec. 23, 1996.

2. Field of the Invention

The present invention relates generally to hand-held alignment tools, and, more particularly, to a hand-held tool especially adapted for aligning trusses or studs in the construction industry.

2. Description of the Prior Art

The need to alignment trusses and studs in the construction industry is well known. In this respect, throughout the years, a number of innovations have been developed relating to hand-held tools used for aiding in the alignment of trusses and studs, and the following U.S. patents are representative of some of those innovations: 4,322,064, 4,704,829, 4,843,726, 5,129,153, and 5,163,233. More specifically, U.S. Pat. No. 4,322,064 discloses a truss alignment tool that employs a plurality of components pivotally connected to each other. Handling pivotally connected alignment members may be cumbersome, especially on elevated structures such as roofs. In this respect, it would be desirable if a truss or stud alignment tool were provided which does not employ segments that are pivotally connected to each other. U.S. Pat. No. 4,704,829 discloses truss clamping devices. Although such clamping devices have important utility, they do not perform an important alignment function. U.S. Pat. No. 4,843,726 discloses a stud alignment and positioning tool that includes components that are nailed to studs which are to be aligned. Nails may be difficult to drive in and subsequently remove. Moreover, when a nail is removed, an undesirable hole may be left. In this respect, it would be desirable if a truss or stud alignment tool were provided which does not employs nails. U.S. Pat. No. 5,129,153 discloses a structural member spacing tool that is limited to the engagement the structural members at the opposed ends thereof. This tool does not provide means for establishing variable spacing between or among structural members. Moreover, this tool does not disclose a cooperating clip for clamping purposes. U.S. Pat. No. 5,163,233 discloses a stud alignment tool that employs a U-shaped clip for engaging a structural member. The U-shaped clip occupies a single fixed position midway between the ends of the tool. Rather than being limited to placement of an alignment tool halfway between adjacent left and right structural members, it would be desirable if a truss or stud alignment tool were provided which provides a variety of alignment distances between the ends of the tool.

Still other features would be desirable in a truss alignment apparatus. For example, it would also be desirable if a truss alignment tool could function as a straight edge and ruler. It would also be desirable if a truss alignment tool can be used for scribing lines on plywood.

Thus, while the foregoing body of prior art indicates it to be well known to use truss alignment devices, the prior art described above does not teach or suggest a truss alignment apparatus which has the following combination of desirable features: (1) does not employ segments that are pivotally connected to each other; (2) performs an important alignment function; (3) does not employs nails; (4) provides means for establishing variable spacing between or among structural members; (5) discloses a cooperating clip for clamping purposes; (6) provides a variety of alignment distances between the ends of the tool; (7) can function as a straight edge and ruler; and (8) can be used for scribing lines on plywood. The foregoing desired characteristics are provided by the unique truss alignment apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a building frame alignment apparatus which includes a T-shaped beam member which includes a top planar portion and a bottom planar portion which projects from the top planar portion at a right angle. A longitudinally oriented leveling indicator assembly is connected to the bottom planar portion, and a transversely oriented leveling indicator assembly is connected to the bottom planar portion. The bottom planar portion includes a plurality of beam-reception notches positioned longitudinally along a bottom edge of the bottom planar portion. Side walls of the beam-reception notches are oriented perpendicular to the top planar portion.

The plurality of beam-reception notches includes a first beam-reception notch located at a first end of the bottom planar portion, a second beam-reception notch located at a second end of the bottom planar portion, and a third beam-reception notch located on the bottom planar portion between the first beam-reception notch and the second beam-reception notch. The beam-reception notches are approximately 1 and ½ inches deep. The beam-reception notches are approximately 1 and 17/32 inches wide. A first separation distance between the first beam-reception notch and the second beam-reception notch is approximately 22 and ½ inches. A second separation distance between the first beam-reception notch and the third beam-reception notch is approximately 14 and ½ inches. A third separation distance between the first beam-reception notch and a first extreme end of the bottom planar portion is approximately 1 and ½ inches. A fourth separation distance between the second beam-reception notch and a second extreme end of the bottom planar portion is approximately 1 and ½ inches.

The beam-reception notches included two side walls and a top wall which is perpendicular to the two side walls. The top planar portion includes a writing-implement access channel. A writing implement, such as a pencil, can be used with the writing-implement access channel to enable scribing on a board. The bottom planar portion bisects the top planar portion.

An adjustable clamping assembly is connected to the top planar portion. The adjustable clamping assembly includes a C-shaped clamping member which fits onto the top planar portion and which has an access gap for receiving the bottom planar portion. A locking member is employed for locking the C-shaped clamping member onto the top planar portion at a selected position on the top planar portion. The locking member is a set screw that screws into a screw-receiving channel in the C-shaped clamping member. Linear measurement indicia are located on the top planar portion.

The building frame alignment apparatus of the invention can be used in a number of ways. A first embodiment of the building frame alignment apparatus is employed so that the first beam-reception notch and the second beam-reception notch can be placed into engagement with two successive diagonal truss beams, respectively. When this is done the trusses can be set leaving both hands free. More specifically, both hands of a worker can be removed from the building frame alignment apparatus when the worker is setting boards across the diagonal truss beams and. Once the initial nailing has been done, the building frame alignment apparatuses of the invention can be moved to successive diagonal beams.

A second embodiment of the building frame alignment apparatus of the invention is employed so that the first beam-reception notch and the second beam-reception notch can be placed into engagement with two successive bottom trusses, respectively. When this is done the trusses can be set leaving both hands of the worker free. More specifically, both hands of the worker can be removed from the building frame alignment apparatus when the worker is setting boards across the bottom trusses and, such as when catwalks or bracing are installed. Once the initial nailing has been done, the building frame alignment apparatuses of the invention can be moved to successive beams.

In another use of the building frame alignment apparatus of the invention, the edges of the top planar portion can be used as a straight edge. Moreover, the presence of the linear measurement indicia permits the top planar portion to be used as a ruler or layout tool.

The first embodiment and the second embodiment of the building frame alignment apparatus can be used together to hold studs in place while toe-nailing.

The adjustable clamping assembly can be adjusted along the top planar portion to enable scribing lines on plywood. In addition, the building frame alignment apparatus of the invention can be used to align trusses while putting plywood on the trusses.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a preferred embodiment of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved truss alignment apparatus which has all of the advantages of the prior art and none of the disadvantages.

It is another object of the present invention to provide a new and improved truss alignment apparatus which may be easily and efficiently manufactured and marketed.

It is a further object of the present invention to provide a new and improved truss alignment apparatus which is of durable and reliable construction.

An even further object of the present invention is to provide a new and improved truss alignment apparatus which is susceptible of a low cost of manufacture with regard to both materials and labor, and which accordingly is then susceptible of low prices of sale to the consuming public, thereby making such truss alignment apparatus available to the buying public.

Still yet a further object of the present invention is to provide a new and improved truss alignment apparatus which does not employ segments that are pivotally connected to each other.

Still another object of the present invention is to provide a new and improved truss alignment apparatus that performs an important alignment function.

Yet another object of the present invention is to provide a new and improved truss alignment apparatus which does not employ nails.

Even another object of the present invention is to provide a new and improved truss alignment apparatus that provides means for establishing variable spacing between or among structural members.

Still a further object of the present invention is to provide a new and improved truss alignment apparatus which discloses a cooperating clip for clamping purposes.

Yet another object of the present invention is to provide a new and improved truss alignment apparatus that provides a variety of alignment distances between the ends of the tool.

Still another object of the present invention is to provide a new and improved truss alignment apparatus which can function as a straight edge and ruler.

Yet another object of the present invention is to provide a new and improved truss alignment apparatus that can be used for scribing lines on plywood.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 1 is a perspective view showing two preferred embodiments of the truss alignment apparatus of the invention used on building frame structures.

FIG. 2 is a perspective view of one of the embodiments of the truss alignment apparatus shown in FIG. 1 removed from the building frame structures.

DESCRIPTION OF THE PREFERRED EMBODIMENT

With reference to the drawings, a new and improved truss alignment apparatus embodying the principles and concepts of the present invention will be described.

Figure 4:
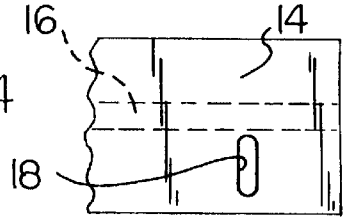
FIG. 4 is a partial top view of the embodiment of the invention shown in FIG. 3.
Figure 3:
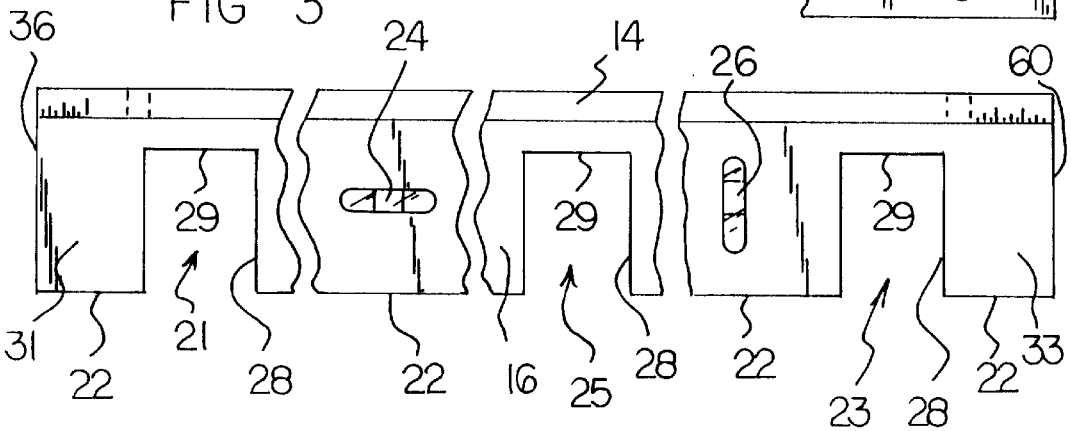
FIG. 3 is a compressed side view of the embodiment of the truss alignment apparatus of FIG. 2.
Figure 5:
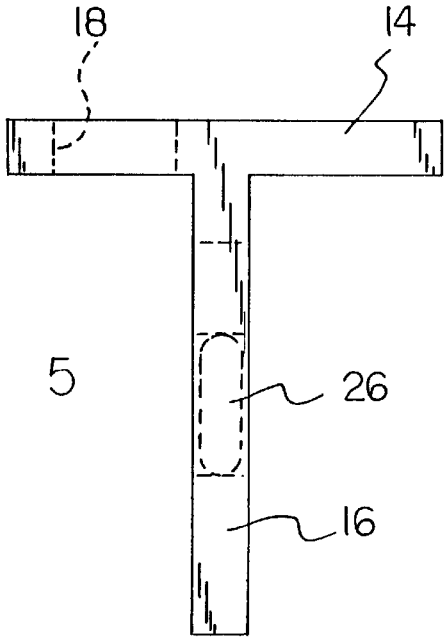
FIG. 5 is an enlarged end view of the embodiment of the invention shown in FIG. 3.
Figure 6:
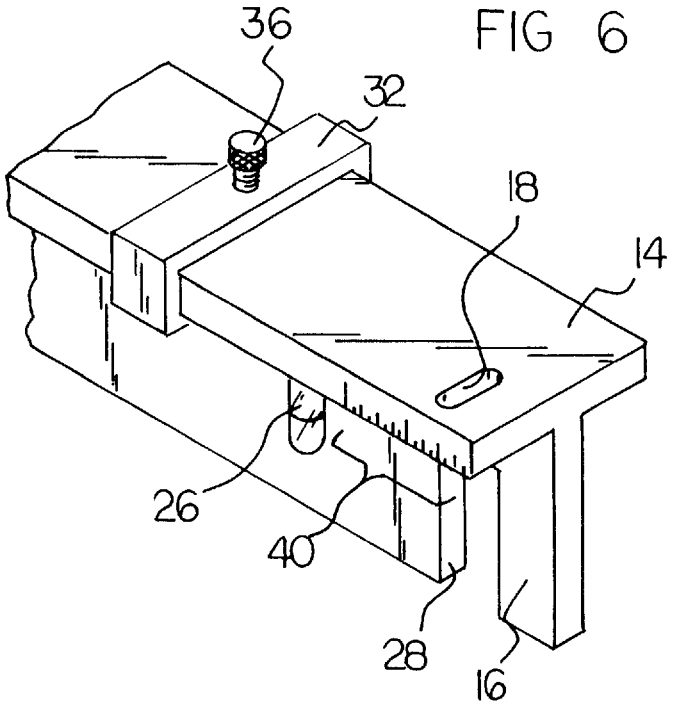
FIG. 6 is a partial perspective view of the embodiment of the invention shown in FIG. 2 further equipped with a measured length adjustment device.
Figure 7:
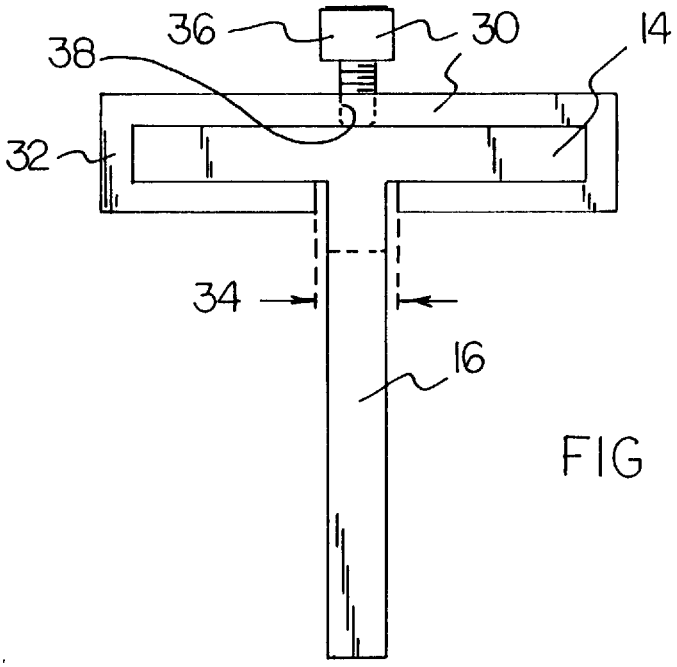
FIG. 7 is an enlarged end view of the embodiment of the invention shown in FIG. 6.

Turning to FIGS. 1–7, there is shown an exemplary embodiment of the truss alignment apparatus of the invention generally designated by reference numeral 10. More specifically, a building frame alignment apparatus 10 includes a T-shaped beam member 12 which includes a top planar portion 14 and a bottom planar portion 16 which projects from the top planar portion 14 at a right angle. A longitudinally oriented leveling indicator assembly 24 is connected to the bottom planar portion 16, and a transversely oriented leveling indicator assembly 26 is connected to the bottom planar portion 16. The bottom planar portion 16 includes a plurality of beam-reception notches positioned longitudinally along a bottom edge 22 of the bottom planar portion 16. Side walls 28 of the beam-reception notches are oriented perpendicular to the top planar portion 14.

The plurality of beam-reception notches includes a first beam-reception notch 21 located at a first end 31 of the bottom planar portion 16, a second beam-reception notch 23 located at a second end 33 of the bottom planar portion 16, and a third beam-reception notch 25 located on the bottom planar portion 16 between the first beam-reception notch 21 and the second beam-reception notch 23. The beam-reception notches are approximately 1 and ½ inches deep. The beam-reception notches are approximately 1 and 17/32 inches wide. A first separation distance 50 between the first beam-reception notch 21 and the second beam-reception notch 23 is approximately 22 and ½ inches. A second separation distance 52 between the first beam-reception notch 21 and the third beam-reception notch 25 is approximately 14 and ½ inches. A third separation distance 54 between the first beam-reception notch 21 and a first extreme end 56 of the bottom planar portion 16 is approximately 1 and ½ inches. A fourth separation distance 58 between the second beam-reception notch 23 and a second extreme end 60 of the bottom planar portion 16 is approximately 1 and ½ inches.

The beam-reception notches included two side walls 28 and a top wall 29 which is perpendicular to the two side walls 28. The top planar portion 14 includes a writing-implement access channel 18. A writing implement, such as a pencil, can be used with the writing-implement access channel 18 to enable scribing on a board. The bottom planar portion 16 bisects the top planar portion 14.

An adjustable clamping assembly 30 is connected to the top planar portion 14. The adjustable clamping assembly 30 includes a C-shaped clamping member 32 which fits onto the top planar portion 14 and which has an access gap 34 for receiving the bottom planar portion 16. A locking member is employed for locking the C-shaped clamping member 32 onto the top planar portion 14 at a selected position on the top planar portion 14. The locking member is a set screw 36 that screws into a screw-receiving channel 38 in the C-shaped clamping member 32. Linear measurement indicia 40 are located on the top planar portion 14.

The building frame alignment apparatus 10 of the invention can be used in a number of ways. As shown in FIG. 1, a first embodiment 70 of the building frame alignment apparatus is employed so that the first beam-reception notch 21 and the second beam-reception notch 23 can be placed into engagement with two successive diagonal truss beams 61 and 63, respectively. When this is done the trusses can be set leaving both hands free. More specifically, both hands of a worker can be removed from the building frame alignment apparatus 10 when the worker is setting boards across the diagonal truss beams 61 and 63. Once the initial nailing has been done, the building frame alignment apparatuses of the invention can be moved to successive diagonal beams.

Also as shown in FIG. 1, a second embodiment 72 of the building frame alignment apparatus of the invention is employed so that the first beam-reception notch 21 and the second beam-reception notch 23 can be placed into engagement with two successive bottom trusses 65 and 67, respectively. When this is done the trusses can be set leaving both hands of the worker free. More specifically, both hands of the worker can be removed from the building frame alignment apparatus when the worker is setting boards across the bottom trusses 65 and 67, such as when catwalks or bracing are installed. Once the initial nailing has been done, the building frame alignment apparatuses of the invention can be moved to successive beams.

In another use of the building frame alignment apparatus 10 of the invention, the edges of the top planar portion 14 can be used as a straight edge. Moreover, the presence of the linear measurement indicia 40 permits the top planar portion 14 to be used as a ruler or layout tool.

The first embodiment 70 and the second embodiment 72 of the building frame alignment apparatus can be used together to hold studs in place while toe-nailing.

The adjustable clamping assembly 30 can be adjusted along the top planar portion 14 to enable scribing lines on plywood. In addition, the building frame alignment apparatus 10 of the invention can be used to align trusses while putting plywood on the trusses.

The components of the truss alignment apparatus of the invention can be made from inexpensive and durable metal and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved truss alignment apparatus that is low in cost, relatively simple in design and operation, and which may advantageously be used to align trusses or studs without employing segments that are pivotally connected to each other. With the invention, a truss alignment apparatus is provided which performs an important alignment function. With the invention, a truss alignment apparatus is provided which does not employs nails. With the invention, a truss alignment apparatus provides means for establishing variable spacing between or among structural members. With the invention, a truss alignment apparatus is provided which discloses a cooperating clip for clamping purposes. With the invention, a truss alignment apparatus provides a variety of alignment distances between the ends of the tool. With the invention, a truss alignment apparatus is provided which can function as a straight edge and ruler. With the invention, a truss alignment apparatus is provided which can be used for scribing lines on plywood.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the following Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the United States is as follows:

1. A building frame alignment apparatus, comprising:

a T-shaped beam member which includes a top planar portion and a bottom planar portion which projects from said top planar portion at a right angle, a longitudinally oriented leveling indicator assembly connected to said bottom planar portion, and a transversely oriented leveling indicator assembly connected to said bottom planar portion, wherein said bottom planar portion includes a plurality of beam-reception notches positioned longitudinally along a bottom edge of said bottom planar portion, wherein side walls of said beam-reception notches are oriented perpendicular to said top planar portion;

further including:

an adjustable clamping assembly connected to said top planar portion, said adjustable clamping assembly comprising a C-shaped clamping member which fits onto said top planar portion and which has an access gap for receiving said bottom planar portion, and a locking member for locking said C-shaped clamping member onto said top planar portion at a selected position on said top planar portion.

2. The apparatus of claim 1 wherein said beam-reception notches are approximately one and one-half inches deep.

3. The apparatus of claim 1 wherein said beam-reception notches are approximately one and seventeen thirtyseconds inches wide.

4. The apparatus of claim 1 wherein said plurality of beam-reception notches include:

a first beam-reception notch located at a first end of said bottom planar portion, a second beam-reception notch located at a second end of said bottom planar portion, and a third beam-reception notch located on said bottom planar portion between said first beam-reception notch and said second beam-reception notch.

5. The apparatus of claim 4 wherein a first separation distance between said first beam-reception notch and said second beam-reception notch is approximately twenty-two and one half inches.

6. The apparatus of claim 5 wherein a second separation distance between said first beam-reception notch and said third beam-reception notch is approximately fourteen and one half inches.

7. The apparatus of claim 6 wherein a third separation distance between said first beam-reception notch and a first extreme end of said bottom planar portion is approximately one and one half inches.

8. The apparatus of claim 7 wherein a fourth separation distance between said second beam-reception notch and a second extreme end of said bottom planar portion is approximately one and one half inches.

9. The apparatus of claim 1 wherein said beam-reception notches include two side walls and a top wall which is perpendicular to said two side walls.

10. The apparatus of claim 1 wherein said top planar portion includes a writing-implement access channel.

11. The apparatus of claim 1 wherein said bottom planar portion bisects said top planar portion.

12. The apparatus of claim 1 wherein said locking member is a set screw that screws into a screw-receiving channel in said C-shaped clamping member.

13. The apparatus of claim 1, further including:

linear measurement indicia located on said top planar portion.

* * * * *